US006087783A

United States Patent [19]

Eastlund et al.

[11] Patent Number: 6,087,783

[45] Date of Patent: Jul. 11, 2000

[54] METHOD AND APPARATUS UTILIZING MICROWAVES TO ENHANCE ELECTRODE ARC LAMP EMISSION SPECTRA

[75] Inventors: Bernard J. Eastlund, Spring, Tex.; Andrew H. Bushnell, San Diego, Calif.

[73] Assignee: Purepulse Technologies, Inc., San Diego, Calif.

[21] Appl. No.: 09/019,392

[22] Filed: Feb. 3, 1998

[51] Int. Cl.[7] ..... H01J 17/20

[52] U.S. Cl. ..... 315/246; 315/39; 315/267; 313/638

[58] Field of Search ..... 315/246, 241 S, 315/241 P, 200 A, 39, 267, 236, 248, 251, 252, 249; 313/570, 308, 638

[56] References Cited

U.S. PATENT DOCUMENTS

| | | | |
|---|---|---|---|
| 4,042,850 | 8/1977 | Ury et al. | 315/39 |
| 4,887,008 | 12/1989 | Wood | 315/39 |
| 5,504,391 | 4/1996 | Turner et al. | 315/246 |
| 5,659,567 | 8/1997 | Roberts et al. | 372/82 |
| 5,834,895 | 11/1998 | Dolan et al. | 313/570 |
| 5,845,480 | 12/1998 | DeFreitas et al. | 60/39.06 |
| 5,864,210 | 1/1999 | Hochi et al. | 315/641 |

*Primary Examiner*—Don Wong
*Assistant Examiner*—Wilson Lee
*Attorney, Agent, or Firm*—Fitch, Even, Tabin & Flannery

[57] ABSTRACT

A system and method for operating a dual electrode flashlamp. The method employs steps of applying an electrical potential between a pair of electrodes of the dual electrode flashlamp; and irradiating a region behind one of said electrodes with microwave energy. The system has a flashlamp bulb; a first electrode positioned at one end of the flashlamp bulb; a second electrode positioned at another end of the flashlamp bulb; and a microwave energy source positioned to direct microwave energy at the flashlamp bulb.

56 Claims, 4 Drawing Sheets

METHOD AND APPARATUS UTILIZING MICROWAVES TO ENHANCE ELECTRODE ARC LAMP EMISSION SPECTRA

BACKGROUND OF THE INVENTION

The present invention relates to flashlamps, and more particularly to microwave assisted flashlamps. Even more particularly, the present invention relates to microwave assisted flashlamps wherein microwaves are used to manipulate dopant levels, and initial and boundary conditions of the flashlamp to advantageously change the emission spectra of the flashlamps.

Flashlamps have heretofore been used in photocopying, curing of UV coatings, laser applications, photo typesetting, visual beacons, and more recently for the destruction of biological organisms. See, for example, U.S. Pat. No. 4,871,559 (Dunn, et al.) for Preservation of Foodstuffs; U.S. Pat. No. 4,910,942 (Dunn, et al.) for Methods for Aseptic Packaging of Medical Device; and U.S. Pat. No. 5,034,235 (Dunn, et al.) for Methods for Preservation of Foodstuffs, all of which are hereby incorporated by reference as if set forth in their entirety.

These applications of flashlamps are limited by the spectral emission characteristics of commercially available flashlamps, which produce a large portion of their emission in the visible and infrared.

A flashlamp is an arc lamp that operates in a pulsed mode, and that is capable of converting stored electrical energy into intense bursts of energy, at typically about 300 kW per cubic centimeter. Irradiated energy from a flashlamp is typically within a spectrum that covers ultraviolet, visible, and infrared light regions. Spectral output is mostly limited to black body-like spectra of Xenon and Krypton gases. The distribution of output between ultraviolet, visible, and infrared light can be altered to a limited extent by varying effective temperature of an irradiating gas. However, this ability to vary the distribution of output is limited, and spectral control, such as in moderate pressure gas discharge lamps, is not available in heretofore known commercially available systems.

Pulsed RF electrodeless lamps have been studied as a means of utilizing dopant atoms in a pulsed discharge by MITRE. (See F. W. Perkins "Blue Green Lasers and Electrodeless Flash Lamps", MITRE Corporation, JHSR-83-101, August, 1983.) The discharges generated by the pulsed RF electrodeless lamps studied by MITRE had limitations due to the interception of RF radiation coils, and were also limited in power density.

Pulsed Microwave lamps have been operated experimentally at levels of 10.4 megawatts per cubic centimeter in KRF laser experiments. The pulsed microwave technology heretofore available is expensive, as compared to electrode flashlamps or electrodeless microwave energized bulbs. (See V. A. Vaulin, et al., "Krypton Fluoride Laser Excited by High Power Nanosecond Microwave Radiation, "Sov. J. Quantum Electron. 18 (11), (November, 1988.)

Electrodeless microwave energized bulbs offer a wide variety of spectra choices, because steady state electrodeless microwave energized bulbs can be produced with dopant atoms such as mercury, iron and copper. (See, for example, U.S. Pat. Nos. 4,042,850; 3,872,349; 3,911,318; 4,887,008; 4,749,915; 4,641,033; 4,887,192; 4,902,935; 4,894,592; 4,507,587; 4,954,755; and 5,051,663.) Commercially available electrodeless microwave energized lamps are limited in power density, as compared to flashlamps, i.e., are limited to about 0.09 to 3 kW per cubic centimeter.

Sulfur and selenium fills for electrodeless and electrode lamps are discussed in U.S. Pat. No. 5,404,076 (Dolan, et al.) and U.S. Pat. No. 5,606,220 (Dolan, et al.), but there is no suggestion that RF or microwave energy be applied to the electrode lamps.

Unlike the above-described approaches, the present invention achieves both high pulsed power levels and dopant handling and/or spectral changing characteristics.

SUMMARY OF THE INVENTION

The invention in various embodiments provides a microwave assisted flashlamp for varying a flashlamp's emission spectra to match specific applications.

In one embodiment the invention can be characterized as a method for energizing gases and plasma discharge in a dual electrode flashlamp with microwaves in order to change the flashlamp's emission characteristics, i.e., emission spectra. The method employs two steps: applying at least one electrical potential across a pair of electrodes of the dual electrode flashlamp to produce an arc discharge between the pair of electrodes; and (2) irradiating a region defined by the arc discharge with microwave energy to increase the energy density in the arc discharge and thus change the lamp's emission characteristics.

In another embodiment the invention can be characterized as a method employing steps of irradiating a volume between a pair of electrodes of a dual electrode flashlamp to produce a microwave discharge between the electrodes and applying at least one electrical potential across the pair of electrodes to produce an arc discharge that develops from initial conditions determined by the microwave discharge, changing the emission spectra of the discharge.

In a further embodiment, the present invention can be characterized as a method for maintaining a controllable dopant level in an arc discharge of a dual electrode flashlamp. The method has steps of applying at least one electrical potential across a pair of electrodes of the dual electrode flashlamp to produce an arc discharge between the pair of electrodes and irradiating a region behind at least one of the electrodes with microwave energy to produce a microwave plasma to cause dopant atoms to be moved into the arc discharge changing the emission spectra of the flashlamp.

In a further embodiment, the invention can be characterized as a system for operating a dual electrode flashlamp. The system has: a flashlamp bulb; a first electrode positioned at one end of the flashlamp bulb; a second electrode positioned at another end of the flashlamp bulb; and a microwave energy applicator positioned to direct microwave energy at an arc region of the flashlamp bulb via coupling around at least one of the electrodes.

In yet a further embodiment, the system employs: a flashlamp bulb; a first electrode positioned at one end of the flashlamp bulb; a second electrode positioned at another end of the flashlamp bulb; and a microwave energy applicator positioned to direct microwave energy to a region between a tip of the electrode and the end of the flashlamp via coupling around at least one of the electrodes.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE PREFERRED EMBODIMENTS

The following description of the presently contemplated best mode of practicing the invention is not to be taken in a limiting sense, but is made merely for the purpose of describing the general principles of the invention. The scope of the invention should be determined with reference to the claims.

Figure 1:
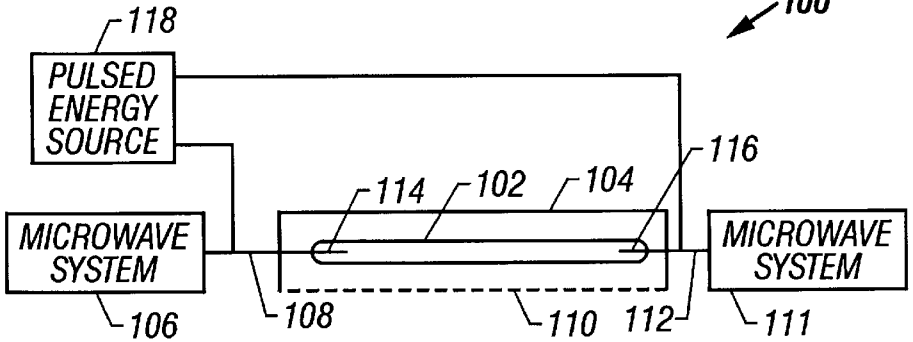
FIG. 1 is a side view of a microwave assisted flashlamp system in accordance with one embodiment of the present invention.

Referring first to FIG. 1, a side view is shown of a microwave assisted flashlamp system 100 in accordance with one embodiment of the present invention.

Shown is a flashlamp 102, a reflector 104, a tungsten mesh screen 110 and first and second sources of microwave energy 106, 111, i.e., microwave systems 106, 111, and a high-voltage pulsed energy source 118. As shown, microwave energy emitted from the sources 106, 111 is coupled into the flashlamp 102 from respective ends 108, 112 of the flashlamp 102. (Note that it will be understood by the skilled artisan that only one microwave energy source coupling microwave energy into the flashlamp from one end of the flashlamp is needed to practice the present invention. Two microwave energy sources are shown in FIG. 1 as a preferred approach in many applications.) Electrodes 114, 116 located at either end of the flashlamp 102 and an arc discharge in the flashlamp form a center conductor of a coaxial transmission line for the microwave energy. A voltage is applied across the electrodes 114, 116 by the pulsed energy source 118 so as to form the arc discharge between the electrodes. The microwave energy sources 106, 111 may operate in either pulsed or continuous modes. The reflector 104 and tungsten mesh screen 110 form an outer conductor of the coaxial transmission line. The coaxial transmission line formed in this manner aids in coupling the microwave energy 108 to the arc discharge. The mesh screen 110 allows light to leave the system, but contains the microwave energy 108 to provide safety for operating personnel.

Operating conditions of flashlamps are described in published literature, for example see "Flashlamp Applications Manual" by EG&G Electro-Optics, 1983. Flashlamps are by-definition "pulsed" lamps in which a large amount of power, typically one million watts or more, is applied to a gas, such as Xenon, between the pair of electrodes 114, 116 of FIG. 1 for a time duration of 1 to 2 milliseconds, with a delay time between pulses of, for example, 0.1 second to 2 seconds or more.

The present embodiment combines features of microwave lamps, e.g., spectral control through control of dopant levels and by providing number density profiles that peak on the circumference of the flashlamp 102, rather than at its centerline, with features of the flashlamp that include its high power density to surprisingly achieve performance not possible with either the microwave source 106 or the flashlamp 102 alone.

For example, when a dopant such as mercury is added to the flashlamp 102, dopant atoms are gradually removed from the arc discharge region by plasma pressure and are deposited in colder regions of the flashlamps behind the electrodes 114, 116, i.e., regions between respective tips of each electrode and respective ends of the flashlamp 102, behind the arc discharge. Addition of microwave energy 108 to form a microwave discharge behind the electrodes 114, 116 can, in accordance with the present embodiments, resupply the dopant atoms to the arc discharge between the tips of the electrodes 114, 116.

By way of another example, microwave energy can be applied to a region between the electrodes 114, 116, creating a microwave discharge, with electron density maximized on a circumference of the flashlamp 102 prior to pulsing a voltage between the electrodes 114, 116 with the pulsed energy source 118. This gives pulsed energy between the electrodes 114, 116 a guiding channel for producing an emission with minimal "line reversal".

Thus, microwave energy 108 is used to manipulate the initial and boundary conditions of the flashlamp 102, so that either line or continuum spectra can be produced to match specific needs (in accordance with particular applications) and to enhance flashlamp lifetime. These advantageous features are accomplished by coupling the microwave energy 108 to an appropriate region of the flashlamp 102. ("Coupling" is the colloquial term used to describe the absorption of microwave energy in a substance, such as the arc of the flashlamp 102 or the area behind an electrode 114 or 116 of the flashlamp 102.)

Figure 3:
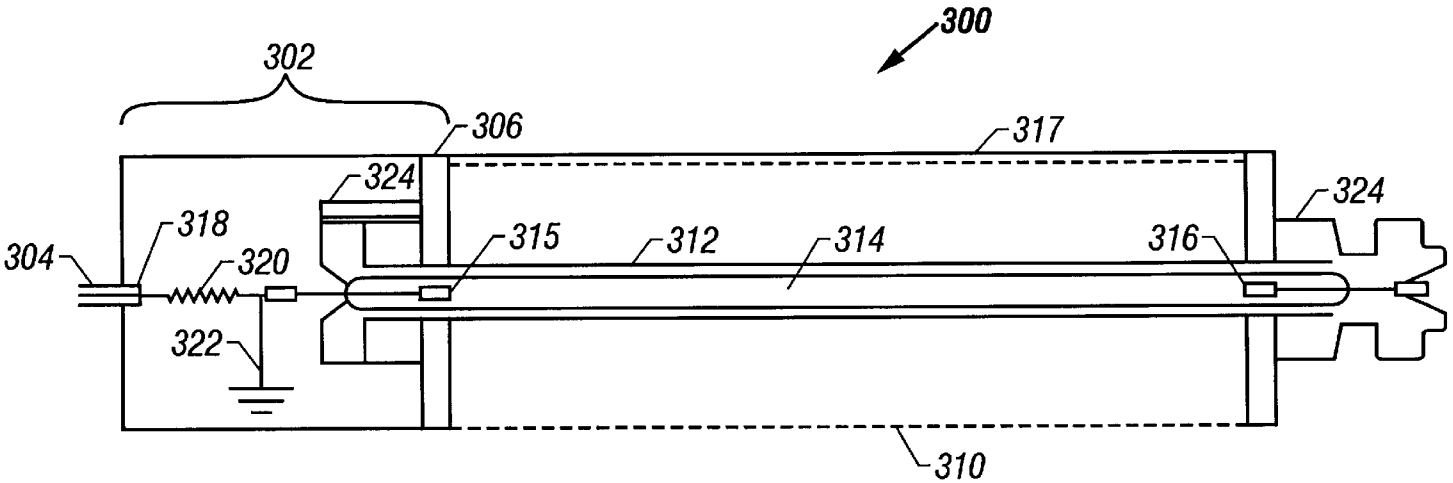
FIG. 3 is a side view of one variation of the microwave assisted flashlamp system of FIG. 1 wherein a single-ended coaxial microwave coupler is employed.

In practice, as explained more fully below, the microwave energy 108 is "coupled" into a transition region 302 (FIG. 3) from a coaxial transmission line 304 (FIG. 3). The transition region 302 (FIG. 3), also serves as a microwave transmission line, which is dimensioned to transmit the microwave energy 108 through an end plate 306 (FIG. 3) of the reflector 104 via a coaxial microwave mode formed by an electrode 315 (FIG. 3) of the flashlamp 102 and a metal aperture in the end plate 306 (FIG. 3).

Once transmitted into an arc discharge region of the flashlamp 102, the microwave energy 108 can be "coupled"

into the arc discharge of the flashlamp 102, either during flashing of the flashlamp 102 (i.e., pulsing of the pulsed energy source 118), or in a simmer plasma created within the flashlamp 102 in a simmer mode, via a variety of microwave "modes". A coaxial mode, shown in FIG. 1 modified for the reflector 104, which is non-azimuthally symmetric, is the preferred mode.

The tungsten mesh screen 110, which is about 96% transparent, is placed across an open end, i.e., side, of the reflector 104 to complete a coaxial waveguide circuit that allows the microwaves to propagate through the full length of the arc discharge region of the flashlamp 102. Advantageously, the tungsten mesh screen 110 also provides for increased personnel safety when personnel are in close proximity to the flashlamp system 100 shown.

When a water jacket 312 (FIG. 3) is used surrounding the flashlamp 102, in order to cool the flashlamp 102 or provide spectral filtration, the microwave energy 108 will transmit through the thin layer of water within the water jacket 312 (FIG. 3), and the water jacket 312 (FIG. 3) itself, with minimal loses.

Figure 2:
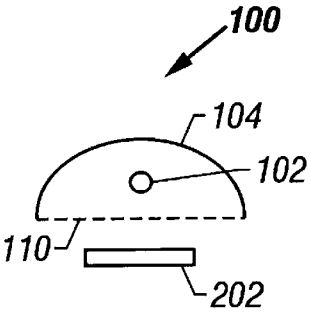
FIG. 2 is an end view of the microwave assisted flashlamp system of FIG. 1.

Referring next to FIG. 2, an end view is shown of the microwave assisted flashlamp system 100 described above. Shown are the reflector 104, the flashlamp 102, and the tungsten mesh screen 110. Also shown is a product 202 to be treated, which may be a food product, a packaging material, a medical apparatus, a medical product, such as a parenteral or enteral package containing sterile water or a dextrose solution, or any of a number of other medical products, or any other product for which the deactivation of microorganisms is desirable.

Referring next to FIG. 3, a side view is shown of a variation of the microwave assisted flashlamp 300 system described above. Shown are the flashlamp 314, a pair of electrodes 315, 316 the reflector 317, the coaxial cable 304 and a connector 318, a flexible wire 320, a ground wire 322, the cylindrical metal transition piece 323 defining the transition region 302 (or transition zone), the end plate 306 of the reflector 317, a pair of water cooling plenums 324, the water cooling jacket 312, and the tungsten mesh screen.

As more generally shown in FIG. 1, the flashlamp 314 is substantially cylindrical shape with the electrodes 315, 316 being located at ends thereof. The flashlamp 314 is held in place by the pair of water cooling plenums 324, which also hold the water cooling jacket concentrically around the flashlamp 314. The water cooling plenums 324 also provide for the passage of water through a space between the water cooling jacket 312 and the flashlamp 314. The reflector 317 is positioned around the flashlamp 314 so as to direct light emitted from the flashlamp 314 toward a product (not shown) to be treated (see the product 202 in FIG. 2). An open end, i.e., side, of the reflector 317 is covered by the tungsten mesh screen 310. Microwaves are coupled via the coaxial cable 304 into the transition region 302, which also serves as a microwave transmission line appropriately dimensioned to transmit the microwave energy through the end plate 306 of the reflector 317.

The tungsten mesh screen 310 has a transparency of about 96% at the wavelengths emitted by the flashlamp 314 and provides control over the microwave mode structure within the arc discharge of the flashlamp 314. The tungsten mesh screen 310 also provides for increased personnel safety.

Figure 4:
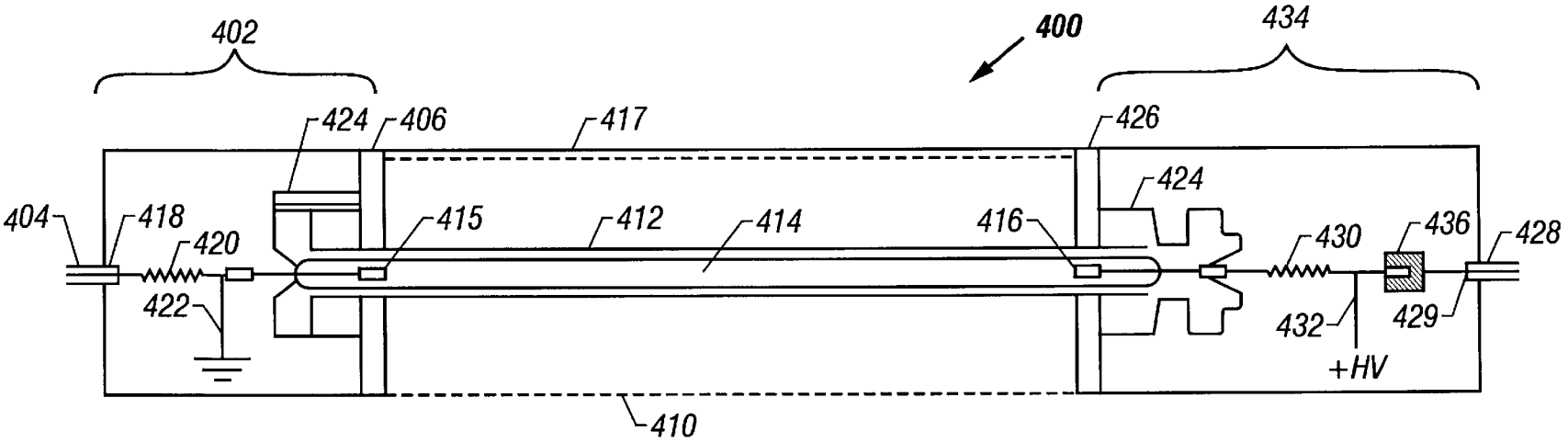
FIG. 4 is a side view of another variation of the microwave assisted flashlamp system of FIG. 1 wherein a double-ended coaxial microwave coupler is employed.

Referring next to FIG. 4, a side view is shown of another variation of the microwave assisted flashlamp system 400 described above. Shown are the flashlamp 414, the electrodes 415, 416, the water jacket 412, the reflector 417, the tungsten mesh screen 410, the water cooling plenums 424, a pair of end plates 406, 426 of the reflector 417, a pair of coaxial cables 404, 428 and connectors 418, 429, a pair of flexible wires 420, 430, a ground wire, a high voltage wire 432 and a pair of cylindrical metal transition regions 402, 434. Also shown on a high-voltage electrode 416 end of the flashlamp 414 is a "hat" coupler 436, which is interposed between the coaxial cable 428 and the flexible wire 430 coupled to the high-voltage electrode 416 of the flashlamp 414. The "hat" coupler 436 imposes a ceramic or other dielectric physical separation that allows transmission of microwaves from the coaxial cable 428 on the high voltage electrode end of the flashlamp 414 to the high-voltage electrode 416 of the flashlamp 414 but not the transmission of direct or alternating current from the high-voltage electrode 416 to the coaxial cable 428.

In accordance with the embodiment of FIG. 4, microwave energy can be coupled into both ends of the arc discharge of the flashlamp 412.

Figure 5:
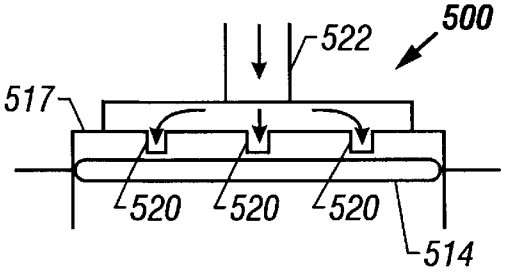
FIG. 5 is a side view of a further variation of the microwave assisted flashlamp system of FIG. 1 wherein a slotted microwave coupler is employed.

Referring next to FIG. 5, a side view is shown of a further variation of the microwave assisted flashlamp system 500 described above. Shown are a flashlamp 514, a reflector 517, which includes a plurality of slots 520, and a microwave coupling structure 522 that distributes microwave energy to the slots 520. The microwave energy can be delivered to the microwave coupling structure 522 via coaxial cables or a wave guide (not shown).

Figure 6:
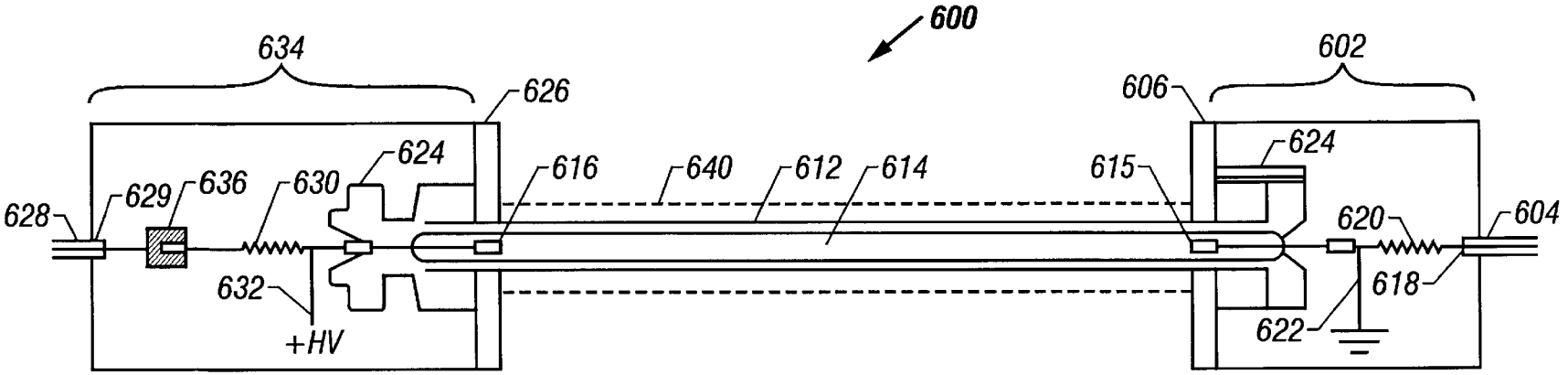
FIG. 6 is a side view of an additional variation of the microwave assisted flashlamp system of FIG. 1 wherein a double-ended coaxial microwave coupler is employed in combination with a cylindrical mesh screen and without a deflector.

Referring next to FIG. 6, a side view is shown of an additional variation of the microwave assisted flashlamp system 600 described above. Shown are a flashlamp 614, electrodes 615, 616, the water cooling plenums 624, a pair of coaxial cables 618, 628, a pair of flexible wires 620, 630, a ground wire 622, a high voltage wire 632, a pair of cylindrical metal transition regions 602, 634, the water cooling jacket 612, and a cylindrical tungsten mesh screen 640.

The present embodiment is particularly advantageous under circumstances wherein flashlamps are mounted in groups, with reflecting surfaces from a few inches to more than a foot away. The microwave coupling structure of the present embodiment is able to propagate microwave energy along the plasma (i.e., or arc discharge) within the flashlamp 614. Control over a heating pattern in the flashlamp 614 is achieved by surrounding the flashlamp 614 with the cylindrical tungsten mesh screen 640. The cylindrical tungsten mesh screen 640 preferably has about 96% transparency at the wavelengths of light emitted from the flashlamp 614, and can be employed with either single or double-ended applications of microwave energy. (A double-ended application of microwave energy is shown in FIG. 6).

Figure 7:
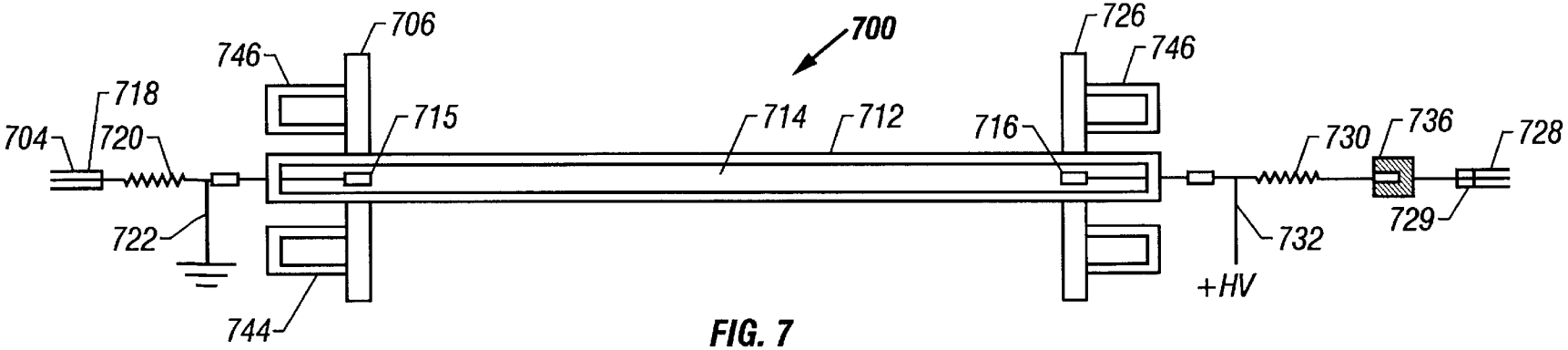
FIG. 7 is a side view of a further additional variation of the microwave assisted flashlamp system of FIG. 1 wherein microwaves are used to resupply dopant from dopant reservoirs to an arc region of the flashlamp.

Referring next to FIG. 7, a side view is shown of a further additional variation of the microwave assisted flashlamp system 700 described above. Shown is a flashlamp 714, a water cooling jacket 712, a pair of electrodes 715, 716, a pair of coaxial cables 704, 728, a pair of flexible wires 720, 730, a ground wire 722, a high-voltage wire 732, and the pair of end plates 706, 726. Also shown is a pair of microwave connections 744 and a pair of microwave slow wave structures 746. In the variation shown, the flashlamp 714 is "doped" with atoms other than noble gas atoms, for example, the flashlamp 714 may be a Xenon flashlamp and may be doped with Mercury atoms. In operation, the so-called "doped" atoms are driven out of the arc of the flashlamp 714 into the to regions beyond, i.e., behind, the electrodes 715, 716 (relative to the arc discharge region).

Heretofore, various attempts to provide "reservoirs" of atoms that will allow replenishment of the doped atoms have not been successful in producing spectra that are characteristic of the doped atoms, while also maintaining flux levels in the same range as a corresponding non-doped flashlamp. This can be due to the need to run the flashlamp at an elevated pressure which can cause line reversal, or at a low pressure, which decreases the number density of emitting atoms and results in too low of a flux.

In accordance with the present embodiments, however, a microwave produced plasma behind and around the electrodes 715, 716 can provide an independently controllable approach to resupplying doped atoms that are moved behind the electrodes 715, 716 by the pressure of the arc discharge of the flashlamp 714.

In the embodiment shown the microwave system 700 is designed to deposit all of its energy in regions behind the electrodes 715, 716, relative to the arc discharge region (i.e., relative to respective tips of the electrodes 715, 716), and is not designed to directly influence the arc discharge. This approach utilizes a well known microwave coupling approach known as a "slow wave structure" 746 in combination with the flashlamp 714.

Typical flashlamp bulbs are specified by physical geometry, materials, and by "fill". The "fill" heretofore most common in commercially available flashlamps is a pure gas of Xenon or Krypton, typically between about 100 and about 750 Torr. The microwave assisted flashlamp systems described herein, however, preferably employ modifications to heretofore commonly used flashlamps. Specifically, the "fill" of doped lamps for microwave operations is a background gas, e.g., between 0 and about 300 Torr of Xenon or Krypton, along with doped atoms of any species with emission properties that are desirable for the particular application in which the present invention is utilized. For example, in ultraviolet light applications, Mercury, Cadmium, and Iron are potential dopants. In visible light applications, Lithium and Sulfur are preferred dopants.

Figure 8:
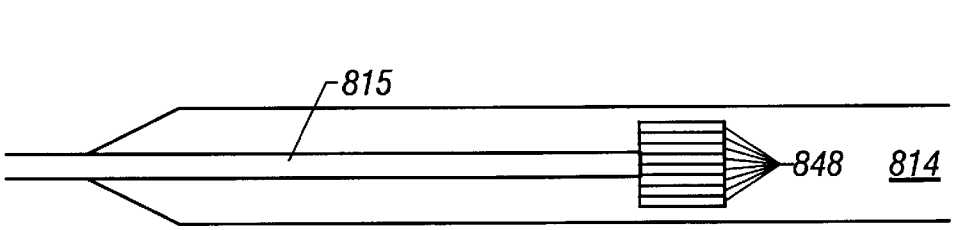
FIG. 8 is a side view of a flashlamp electrode useable in the variation of FIG. 7 made up of a collection of tubes that serve as collimators for a flux of dopant atoms.

Referring next to FIG. 8, a side view is shown of a portion of a flashlamp useable with the variations of the present invention described above. The flashlamp 814 includes an electrode 815 that includes a collection of metal tubes 848 at its distal end. The tubes can be fabricated with tungsten metal, with each tube having a diameter of 0.1 millimeter and a wall thickness of 0.02 millimeters. Parameters of the flashlamp fill are selected such that a microwave plasma can, in accordance with the present variation, utilize the metal tubes 848 to collimate the flux of doped atoms back into the arc of the flashlamp plasma (i.e., to the right as oriented in FIG. 8). For example, if the inner diameter of the quartz envelope is 9 mm and the diameter of a solid cathode is 7 mm, then the cross sectional area available to project atoms of a dopant element back into the discharge is 0.25 $cm^2$. About 5,000 tubes as defined above can form a cathode of 7 millimeters diameter and increase the effective cross sectional area to 0.38 $cm^2$. This is an increase of 50%. These tubes can be fabricated by laser drilling of flat stock.

Figure 9:
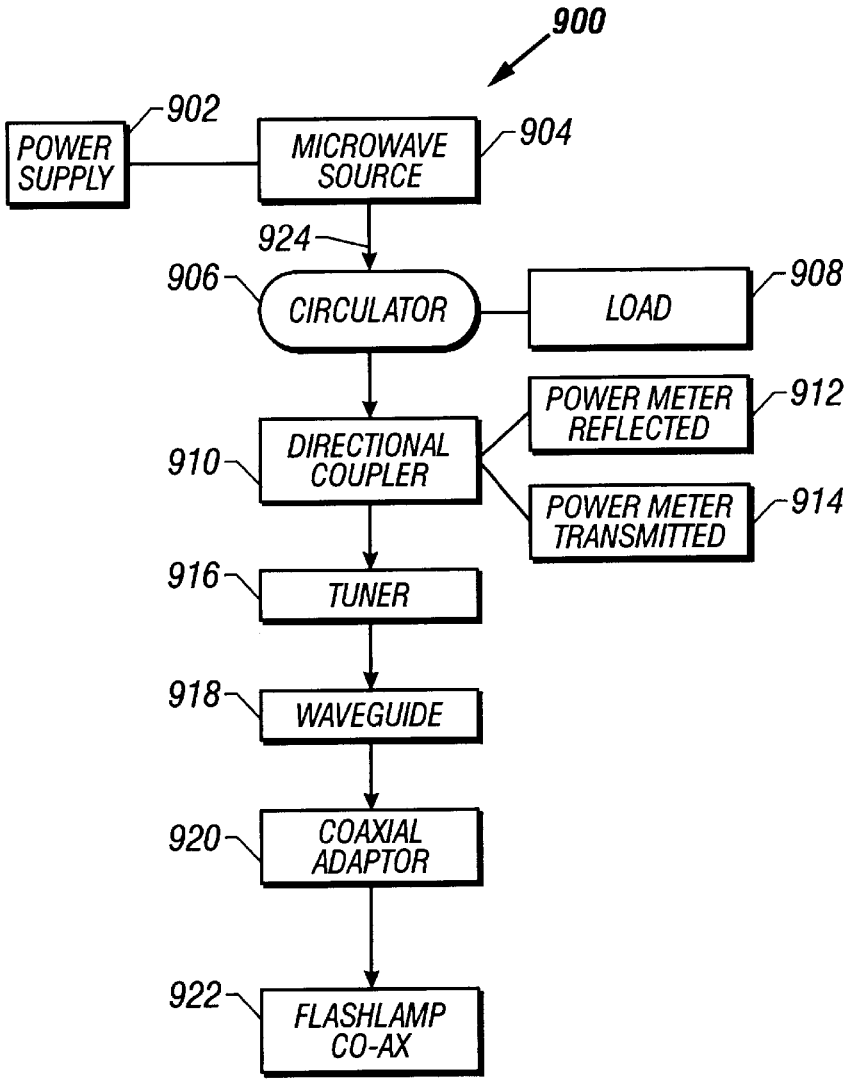
FIG. 9 is a block diagram of a microwave system that can be used in combination with the microwave assisted flashlamp system of FIG. 1.

Referring next to FIG. 9, a block diagram is shown of a microwave system 900 that can be used in combination with the various microwave assisted flashlamp systems described above. Shown are a power supply 902, a microwave source 904, a circulator 906, a load 908, a directional coupler 910, a power reflected meter 912, a power transmitted meter 914, a tuner 916, a waveguide 918, a coaxial adapter 920, and a coaxial cable 922.

The microwave source 904 is preferably a 2450 MHz variable 0.25 kW microwave power source with 20% ripple (full wave rectified). A Hitatchi M131 magnetron is an example of a suitable microwave power source. The output of the microwave source 904 is fed via a rectangular waveguide 918 to the circulator 906 for protecting the microwave source 904, i.e., for protecting a magnetron in the microwave source 904. The load 908 is used to absorb reflected microwave energy deflected by the circulator 906. An output of the circulator 906 is directed to a directional coupler 910 that measures a power flow in forward and reverse directions simultaneously. An output of the directional coupler 910 is fed to a three-stub tuner, i.e., the tuner 916, to provide maximum transfer of power to the waveguide 918. The tuner 916 provides structure for matching the impedance of the waveguide 918 to the microwave source 904. The output of the tuner 916 is fed to the waveguide 918, which in turn directs the microwave energy carried thereby to the coaxial adaptor 920 and then to the coaxial cable 922.

EXAMPLE 1

Figure 10:
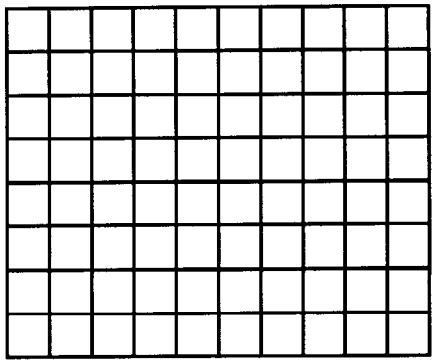
FIG. 10 is graphical representation of an exemplary oscilloscope display output representing electrical potential across the electrodes of the flashlamp of FIG. 1 when microwaves are not supplied to the flashlamp.
Figure 11:
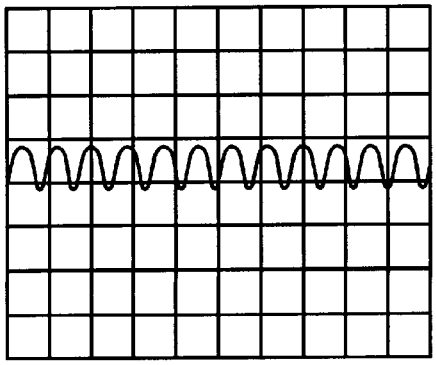
FIG. 11 is a graphical representation of an exemplary oscilloscope display output representing electrical potential across the electrodes of the flashlamp of FIG. 1 when microwaves are supplied to the flashlamp.

A Xenon flashlamp filled with Xenon at 200 Torr and a 1.5 ml Mercury ball is operated in simmer mode with 1.6 amps of current and 100 to 150 volts potential. A simmer circuit, such as is known in the art, is designed to maintain a constant current between the electrodes of the flashlamp in simmer mode. The effect of the microwave energy within the arc discharge of the flashlamp is observed in a change of the voltage across the flashlamp. FIG. 10 shows voltage across the flashlamp with the microwave energy turned off, and FIG. 11 shows a voltage across the flashlamp with the microwave energy turned on. The ripple is indicated by the 120 Hz modulated microwave source. The results depicted in FIGS. 10 and 11 suggests that the total resistivity of the flashlamp varies from greater than normal to less than normal under the effects of microwave energy.

Using the same flashlamp, it is also demonstrated that the flashlamp can be "turned on" with microwave energy of about 650 watts and that under such conditions, the plasma between the electrodes reaches about 4 inches along the flashlamp. The ability to manipulate the "simmer" plasma and to produce a plasma with microwave energy is thus demonstrated.

EXAMPLE 2

For a 450 Torr Xenon flashlamp with a 0.6 ml Mercury ball contained therein, a Mercury spectrum is observed when the lamp is flashed, however, the Mercury spectrum decreases as the lamp continues to flash due to the effect of the "pumping" of the Mercury out of the arc discharge region of the flashlamp. Once the Mercury spectrum has all but vanished from the light produced by the flashlamp, microwave energy at 900 Watts is applied behind the electrodes and the intensification of the Mercury spectrum is observed, thus demonstrating that the microwave energy introduced into the arc discharge of the flashlamp can result in the resupply of dopant to the flashlamp's arc discharge. After repeating this process several times, the microwave energy, if applied at only one electrode, is finally unable to reintensify the Mercury spectrum. Accumulation of Mercury is observed behind the electrode opposite the electrode at which the microwave energy is applied.

An ultraviolet detector can be mounted to receive light from the center of the flashlamp and detect one or more dopant emission lines. In the case of a mercury dopant, a line at 2536.52 angstroms is suitable. Dopant emission level can be maintained at a constant level by feedback control, i.e., if the detected emission drops in power, then the operating point of the microwave source 904 of FIG. 9 is changed to provide more microwave power. Likewise, if the detected emission increases in power, then the operating point of the microwave source 904 of FIG. 9 is changed to provide less microwave power. This adjustment can be accomplished with a power supply such as is marked by Acopian as Model Number B12G900, DC voltage power supply.

It is significant, particularly in microorganism deactivation applications, that the doping of Xenon flashlamps with Mercury results in an increased spectral output in the 200 to 300 nanometer wavelength range while maintaining total radiance of the flashlamp. This advantageous feature of Mercury doped Xenon flashlamps can now be capitalized upon due to the ability of the embodiments described herein to return the Mercury to the flashlamp's plasma, thus overcoming the tendency of the flashlamp to "pump" the Mercury out of the plasma to the regions behind each of the electrodes.

While the invention herein disclosed has been described by means of specific embodiments and applications thereof, numerous modifications and variations could be made thereto by those skilled in the art without departing from the scope of the invention set forth in the claims.

What is claimed is:

1. A method of energizing the gases and plasma discharge in a dual electrode flashlamp with microwaves comprising:

applying at least one electrical potential across a pair of electrodes of the dual electrode flashlamp to produce an arc discharge between the pair of electrodes; and irradiating the arc discharge with microwaves to change the emission spectra of the arc discharge.

2. The method of claim 1 wherein said irradiating includes coupling the microwaves along a coaxial transmission line formed with one of said pair of electrodes as a center conductor.

3. The method of claim 2 wherein said irradiating further includes coupling the microwaves along another coaxial transmission line formed with another of said pair of electrodes as said center conductor.

4. The method of claim 1 wherein said irradiating includes coupling the microwaves along a microwave coaxial transmission line formed with one of said pair of electrodes and a hat coupler as a center conductor.

5. The method of claim 1 further comprising:

surrounding, at least partially, said arc discharge between said pair of electrodes with a slotted microwave coupler.

6. The method of claim 1 wherein said applying of electrical potential is pulsed in time with a pulse duration of up to 2 milliseconds and with a pulse repetition rate of from between 1 Hz to 1200 Hz.

7. The method of claim 1 wherein said irradiating with microwaves is pulsed in time with a pulse duration of from between 2 milliseconds and continuous operation.

8. A method of energizing plasma discharge in a dual electrode flashlamp comprising:

irradiating a region between a pair of electrodes of a dual electrode flashlamp to produce a microwave discharge between the electrodes; and applying at least one electrical potential across the pair of electrodes to add additional energy to the microwave discharge between the pair of electrodes.

9. The method of claim 8 wherein said irradiating includes coupling the microwaves along a coaxial transmission line formed with one of said pair of electrodes as a center conductor.

10. The method of claim 9 wherein said irradiating includes coupling the microwaves along another coaxial transmission line formed with another of said pair of electrodes as a center conductor.

11. The method of claim 8 wherein said irradiating includes coupling the microwaves along a coaxial transmission line formed with one of said pair of electrodes and a hat coupler as a center conductor.

12. The method of claim 8 further comprising:

surrounding, at least partially, said arc discharge between said pair of electrodes with a slotted microwave coupler.

13. The method of claim 8 wherein said applying of electrical potential is pulsed in time.

14. The method of claim 8 wherein said irradiating with microwaves is pulsed in time.

15. A method of maintaining a controllable dopant level in a flashlamp comprising:

applying at least one electrical potential across a pair of electrodes of the flashlamp;

irradiating gas behind at least one of the electrodes to generate a microwave discharge in that region;

adjusting power applied to the microwave discharge behind the electrodes to cause dopant atoms to be moved into the arc discharge region;

adjusting the power applied to the arc discharge between the electrodes to cause said dopant atoms to be returned to a region behind the electrodes; and repeating the adjusting of the power applied to the microwave discharge and the adjusting of the power applied to the arc discharge until a steady state dopant level and prescribed emission spectra are achieved.

16. The method of claim 15 wherein said irradiating includes coupling the microwaves along a coaxial transmission line formed with one of said pair of electrodes as a center conductor.

17. The method of claim 16 wherein said irradiating includes coupling the microwaves along another coaxial transmission line formed with another of said pair of electrodes as a center conductor.

18. The method of claim 15 wherein said irradiating includes coupling the microwaves along a microwave coaxial transmission line formed with one of said pair of electrodes and a hat coupler as a center conductor.

19. The method of claim 15 wherein said irradiating includes coupling said microwaves through a slow wave structure surrounding the at least one of said electrodes.

20. The method of claim 15 wherein said applying of electrical potential is pulsed in time.

21. The method of claim 15 wherein said irradiating with microwaves is pulsed in time.

22. A system for operating a dual electrode flashlamp comprising:

a flashlamp bulb;

a first electrode positioned at one end of the flashlamp bulb;

a second electrode positioned at another end of the flashlamp bulb;

a pulsed electrical potential source connected to the electrodes;

microwave coupling structures;

a microwave energy source coupled to the microwave coupling structures; and an electronic control system for timing operation of the electrical potential source and the microwave energy source.

23. The system of claim 22 wherein said first and second electrodes define an arc discharge region thereinbetween, and wherein said microwave energy source is positioned to direct microwave energy into the arc discharge region.

24. The system of claim 22 further comprising:

a first microwave transmission line formed with said first electrode as a center conductor.

25. The system of claim 24 further comprising:

a second microwave transmission line formed with said second electrode as said center conductor.

26. The system of claim 22 further comprising a first microwave transmission line formed with said first electrode and a hat coupler a center conductor.

27. The system of claim 22 wherein said microwave energy source is positioned to direct microwave energy at the flashlamp bulb into a region behind the first electrode.

28. The system of claim 27 further comprising another microwave energy source positioned to direct microwave energy at the flashlamp bulb into a region behind the second electrode.

29. The system of claim 22 further comprising:

a slow wave structure coupled to the first electrode to direct microwave energy into a region behind the first electrode.

30. The system of claim 22 further comprising:

a reflector at least partially surrounding said flashlamp bulb to form at least a portion of an outer conductor of a microwave transmission line.

31. The system of claim 30 further comprising:

an open side of said reflector; and a mesh screen covering at least a portion of said open side.

32. The system of claim 22 further comprising:

a reflector at least partially surrounding said flashlamp bulb; and at least one slot in said reflector through which said microwave energy is directed into said arc discharge region.

33. The system of claim 22 further comprising:

a mesh screen enveloping at least a portion of said flashlamp bulb.

34. The system of claim 30 wherein said first and second electrodes define an arc discharge region thereinbetween, and wherein said first electrode includes a plurality of collimating tubes proximate said arc discharge region for collimating flow of dopant atoms.

35. A method of operating a dual electrode flashlamp comprising:

energizing an electrical potential across a pair of electrodes of the dual electrode flashlamp, the pair of electrodes defining an arc region thereinbetween; and irradiating the arc region with microwave energy.

36. The method of claim 35 wherein said irradiating includes coupling said microwave energy through one of said pair of electrodes.

37. The method of claim 36 wherein said irradiating includes coupling said microwave energy through another of said pair of electrodes.

38. The method of claim 37 wherein said coupling said microwave energy through said other of said pair of electrodes includes coupling said microwave energy through a hat coupler.

39. The method of claim 35 wherein said irradiating includes coupling said microwave energy through a slotted microwave coupler.

40. The method of claim 35 wherein said irradiating includes coupling said microwave energy through a slow wave structure.

41. A method of operating a dual electrode flashlamp comprising:

energizing an electrical potential across a pair of electrodes of the dual electrode flashlamp; and irradiating a region behind a tip of one of the electrodes with microwave energy.

42. The method of claim 41 wherein said energizing includes delivering a pulse of said electrical potential across said pair of electrodes.

43. A system for operating a dual electrode flashlamp comprising:

a flashlamp bulb;

a first electrode positioned at one end of the flashlamp bulb; and a second electrode positioned at another end of the flashlamp bulb; and a microwave energy source positioned to direct microwave energy at the flashlamp bulb.

44. The system of claim 43 wherein said first and second electrodes define an arc region thereinbetween and wherein said microwave energy source is positioned to direct microwave energy into the arc region.

45. The system of claim 44 further comprising a slow wave structure from which said microwave energy is directed into said arc region.

46. The system of claim 43 further comprising means for coupling said microwave energy into said flashlamp through said first electrode.

47. The system of claim 45 comprising means for coupling said microwave energy into said flashlamp through said second electrode.

48. The system of claim 46 wherein said means for coupling said microwave energy into said flashlamp through said second electrode includes a hat coupler.

49. The system of claim 43 wherein said microwave energy source is positioned to direct microwave energy at the flashlamp bulb behind the first electrode.

50. The system of claim 48 including another microwave energy source is positioned to direct microwave energy at the flashlamp bulb behind the second electrode.

51. The system of claim 43 further comprising a reflector positioned about said flashlamp bulb to reflect light emitted therefrom to a target object.

52. The system of claim 51 wherein said reflector includes an open side.

53. The system of claim 52 wherein said reflector includes a mesh screen over at least a portion of said open side.

54. The system of claim 51 wherein said reflector includes at least one slot through which said microwave energy is directed into said arc region.

55. The system of claim 43 further comprising a mesh screen enveloping at least a portion of said flashlamp bulb.

56. The system of claim 43 wherein said first electrode includes a plurality of collimating tubes proximate said arc region for collimating said microwave energy.

* * * * *

UNITED STATES PATENT AND TRADEMARK OFFICE
CERTIFICATE OF CORRECTION

PATENT NO : 6,087,783
DATED : July 11, 2000
INVENTOR(S) : Eastland, et al.

It is certified that error appears in the above-identified patent and that said Letters Patent are hereby corrected as shown below:

IN THE CLAIMS: At column 11, line 13, change "a hat coupler a center conductor" to --a hat coupler as a center conductor--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*